US008231421B1

(12) United States Patent
Hubbard et al.

(10) Patent No.: US 8,231,421 B1
(45) Date of Patent: Jul. 31, 2012

(54) INFLATABLE WET SUIT

(75) Inventors: John David Hubbard, Oceanside, CA (US); Patrick Shane Dorian, Holualoa, HI (US)

(73) Assignee: GSM (Operations) Pty Ltd, Burleigh Heads, Queensland (AU)

( * ) Notice: Subject to any disclaimer, the term of this patent is extended or adjusted under 35 U.S.C. 154(b) by 2 days.

(21) Appl. No.: 13/022,607

(22) Filed: Feb. 7, 2011

(51) Int. Cl.
*B63C 9/15* (2006.01)

(52) U.S. Cl. ..... 441/92; 441/96; 441/103

(58) Field of Classification Search ..... 441/92, 441/96, 102, 103
See application file for complete search history.

(56) References Cited

U.S. PATENT DOCUMENTS

| | | | | |
|---|---|---|---|---|
| 822,882 | A * | 6/1906 | Citron | 441/96 |
| 2,118,165 | A | 5/1938 | Christopher et al. | |
| 2,195,736 | A | 4/1940 | Myers | |
| 3,199,128 | A * | 8/1965 | Nojd | 441/89 |
| 5,295,765 | A | 3/1994 | Choi | |
| 5,456,623 | A * | 10/1995 | Norris | 441/92 |
| 5,603,646 | A * | 2/1997 | Tobias | 441/94 |
| 5,839,932 | A * | 11/1998 | Pierce et al. | 441/80 |
| 6,108,816 | A * | 8/2000 | Bradley | 2/102 |
| 6,231,411 | B1 * | 5/2001 | Vinay | 441/120 |
| 6,478,509 | B2 * | 11/2002 | Powley | 405/186 |
| 6,666,622 | B1 | 12/2003 | Courtney et al. | |
| 6,976,894 | B1 | 12/2005 | Turner | |
| 7,150,668 | B2 | 12/2006 | Kemp | |
| D536,860 | S * | 2/2007 | Hoey | D2/830 |
| 7,351,126 | B2 | 4/2008 | Turner | |
| 7,699,679 | B2 | 4/2010 | Lahyani | |
| 2005/0020155 | A1 * | 1/2005 | Spagnuolo | 441/92 |
| 2007/0056500 | A1 * | 3/2007 | Beck | 116/210 |
| 2010/0015867 | A1 * | 1/2010 | Betz et al. | 441/92 |
| 2011/0009020 | A1 | 1/2011 | Withers et al. | |

FOREIGN PATENT DOCUMENTS

| | | |
|---|---|---|
| FR | 2 789 651 | 8/2000 |
| JP | 2002-234489 | 8/2002 |

* cited by examiner

*Primary Examiner* — Stephen Avila
(74) *Attorney, Agent, or Firm* — Nixon & Vanderhye P.C.

(57) ABSTRACT

Wet suits used by water sports enthusiasts (e.g., surfers) are provided with the ability to be inflated during emergency situations to provide life-saving buoyancy and floatation aid. The inflatable wet suit will preferably include a torso section having a back pocket and a bladder assembly having an inflatable bladder bag and an inflator valve adapted for operative connection with a compressed gas canister positioned within the back pocket. A rip cord has one of its ends connected to the inflator valve and extends over a shoulder region of the torso section so that the other end thereof is graspably positioned adjacent a front portion of the torso section. A canister pouch within the back pocket of the torso section is provided for receiving the gas canister therein. The canister pouch includes a front wall attached to the torso section along side and bottom edges.

20 Claims, 7 Drawing Sheets

INFLATABLE WET SUIT

FIELD

The embodiments disclosed herein relate generally to wet suits used by water sports enthusiasts (e.g., surfers) having the ability to be inflated during emergency situations to provide life-saving buoyancy and floatation aid.

BACKGROUND

Personal floatation devices (sometimes colloquially known as "life vests") are well known. More recently, several proposals have been made to combine a wet suit with inflation capabilities so as to provide the wearer with an emergency floatation aid as evidenced by U.S. Pat. Nos. 6,976,894, 7,351,126 and 7,699,679 (the entire content of each such prior-issued U.S. patent being expressly incorporated herein by reference).

While the inflatable wet suits in the art appear to be suitable for their intended purpose, some improvements are still desirable. It is toward providing such improvements that the present invention is directed.

SUMMARY

According to the embodiments disclosed herein, wet suits used by water sports enthusiasts (e.g., surfers) are provided with the ability to be inflated during emergency situations to provide life-saving buoyancy and floatation aid. In especially preferred embodiments, the inflatable wet suit will include a torso section having a back pocket and a bladder assembly having an inflatable bladder bag and an inflator valve adapted for operative connection with a compressed gas canister positioned within the back pocket. A rip cord has one of its ends connected to the inflator valve and extends over a shoulder region of the torso section so that the other end thereof is graspably positioned adjacent a front portion of the torso section.

A canister pouch within the back pocket of the torso section is provided for receiving the gas canister therein. The canister pouch includes a front wall attached to the torso section along side and bottom edges thereof with a top edge being unattached to the torso section so as to define a pouch space with an open upper end. The front wall also preferably includes at least one cut-out region to allow manual manipulation of the gas canister positioned in the pouch space.

According to some embodiments, the canister pouch may include a top flap fixed to the torso section about top and lateral edges thereof so as to provide an unsecured bottom edge to allow the top flap to extend over and thereby close the open upper end of the pouch space. The top flap may include an opening therein to allow a neck of the gas canister to protrude therethrough and permit operative coupling of the gas canister to the inflator valve.

A handle assembly is preferably provided which is connected to the other end of the rip cord. According to some embodiments, the handle assembly may include an attachment to removably attach the hand handle assembly to the front portion of the torso section. A strap member may be provided to carry the attachment means.

According to certain disclosed embodiments, the handle member may include an aligned series of beads with a strap member bridging the beads such that proximal and distal ends of the strap member are connected adjacent to proximal and adjacent ones of the beads, respectively.

Some embodiments of the inflatable wet suit may be provided with a deflation assembly connected operatively to the bladder bag so as to allow for manual deflation of the bladder bag. If provided, the deflation assembly will preferably include an elongate flexible deflation tube having a proximal end connected operatively to the bladder bag, and a manually operated normally closed deflation valve positioned at a distal end of the deflation tube.

These and other aspects and advantages of the present invention will become more clear after careful consideration is given to the following detailed description of the preferred exemplary embodiments thereof.

BRIEF DESCRIPTION OF ACCOMPANYING DRAWINGS

The disclosed embodiments of the present invention will be better and more completely understood by referring to the following detailed description of exemplary non-limiting illustrative embodiments in conjunction with the drawings of which:

DETAILED DESCRIPTION

Figure 1A:
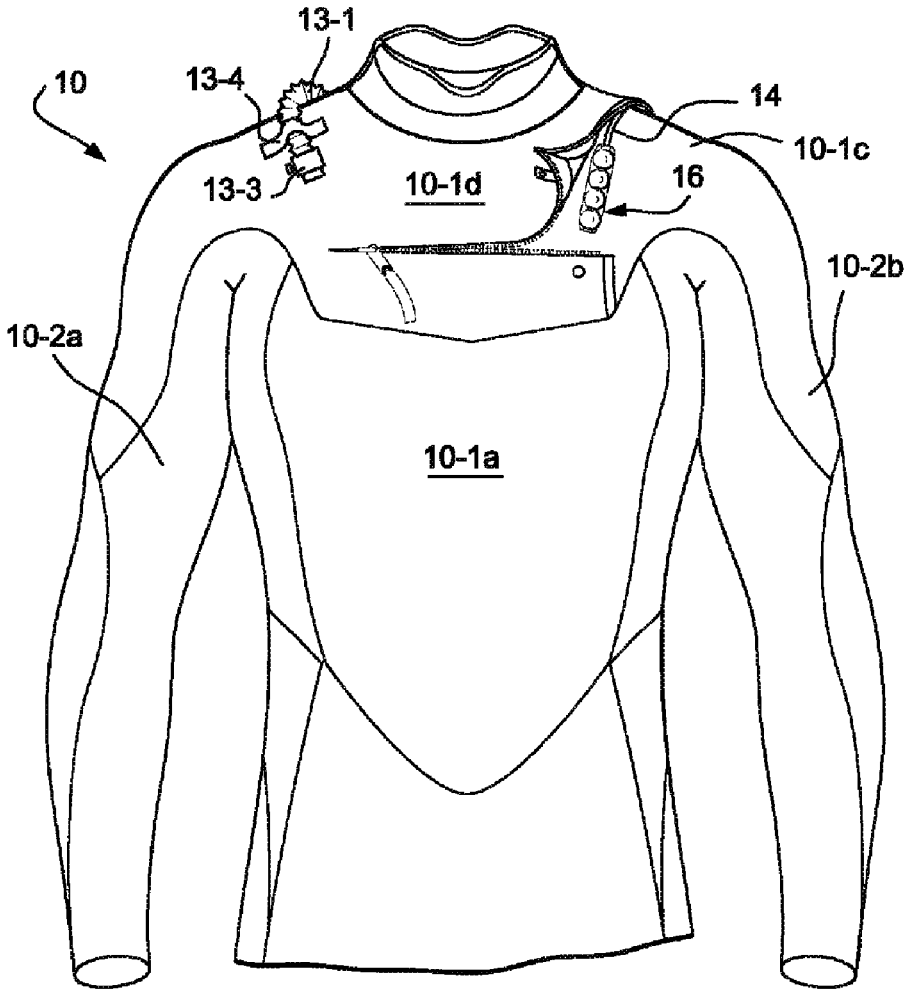
FIGS. 1A and 1B are front and rear elevational views, respectively, of an inflatable wet suit embodying the present invention.
Figure 1B:
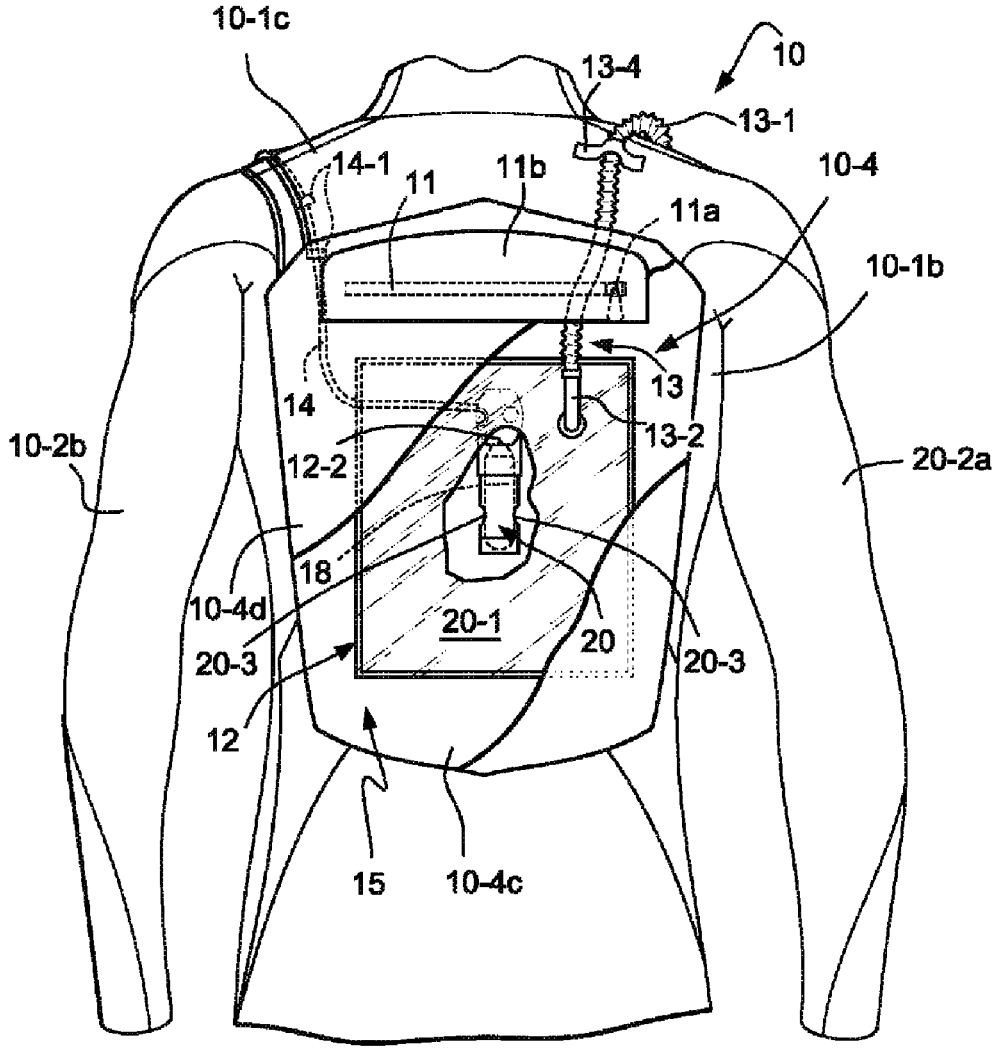

An exemplary embodiment of an inflatable wet suit 10 is depicted in FIGS. 1A and 1B as being in the form of a so-called full body suit having front and rear torso sections 10-1*a*, 10-1*b*, respectively, and right and left arm sections 10-1*a*, 10-1*b*. Although not shown, right and left leg sections extending downwardly from the torso sections 10-1*a*, 10-1 may be provided to cover the wearer's legs. As is conventional, the various sections of the wet suit 10 are constructed from a rubber material (e.g., neoprene).

Although depicted as a full body suit in FIGS. 1A and 1B, the wet suit 10 which embodies the present invention may be provided with a variety of coverages for the wearer, such as partial wet suits which include shortened leg and/or arm sections or vest suits (wherein just a torso section is provided). Thus, all varieties and variants of wet suits may advantageously be provided with emergency inflation capability of the embodiments of the present invention.

The wet suit 10 is provided with a back pocket 10-4 having an access opening 11 closed by a closure member 11*a* (e.g., a zipper or equivalent closure system, e.g., snaps, hook and loop fasteners or the like). The access opening 11 is preferably covered by a flap 11*b* associated with the pocket 10-4. The pocket 10-4 is sized and configured to accept therein an inflatable bladder assembly 12 comprised of a flexible bladder bag 12-1 and an inflator valve 12-2. The bladder assembly 12 is in and of itself conventional and can be obtained commercially from Mustang Survival Corporation of British Columbia, Canada.

The inflator valve 12-2 includes an actuator lever 12-2*a* (see FIG. 3) which is connected to one end of a pull cord 14. The pull cord 14 is directed over the shoulder region 10-1*c* of the wet suit 10 and terminates at its other end with a handle assembly 16 positioned on the upper part of the front torso section 10-1*a* below the bib flap 10-1*d* (which in the view shown by FIG. 1A has been folded away to reveal the handle assembly 16 therebelow). The inflator valve 12-2 is threadably connected to the threaded stem 18*a* (see FIG. 2) of a conventional gas canister 18 which contains compressed gas of sufficient volume (e.g., a $CO_2$ canister of conventional size from about 20- to about 35 grams) to expand and thereby inflate the bladder bag 12-1 upon actuation of the inflator valve 12-2. The gas canister is positionally retained in a canister pouch 20 to be described in greater detail below.

In order to allow manual deflation of the bladder bag 12-1 following its inflation, a deflation assembly 13 is provided. The deflation assembly 13 includes an elongate flexible deflation tube 13-1 which is connected at its proximal end to a deflation nipple 13-2 associated with the bladder bag 12-1. The deflation tube 13-1 extends from the deflation nipple 13-2 to a manually operated normally closed deflation valve 13-3 (see FIG. 1A) located at its distal end. The deflation tube 13-1 may be retained positionally by one or more material loops 13-4 associated with the suit and/or by any suitable two-part fastening system (e.g., VELCRO-Brand hook and loop fasteners). Although depicted as being positioned over the wearer's shoulder, other placements of the deflation tube 13-1 and its associated deflation valve 13-3 are of course possible. For example, the tube could be positioned near the wearer's waist region or maintained in the interior of the back pocket 10-4 for access when needed.

Figure 2:
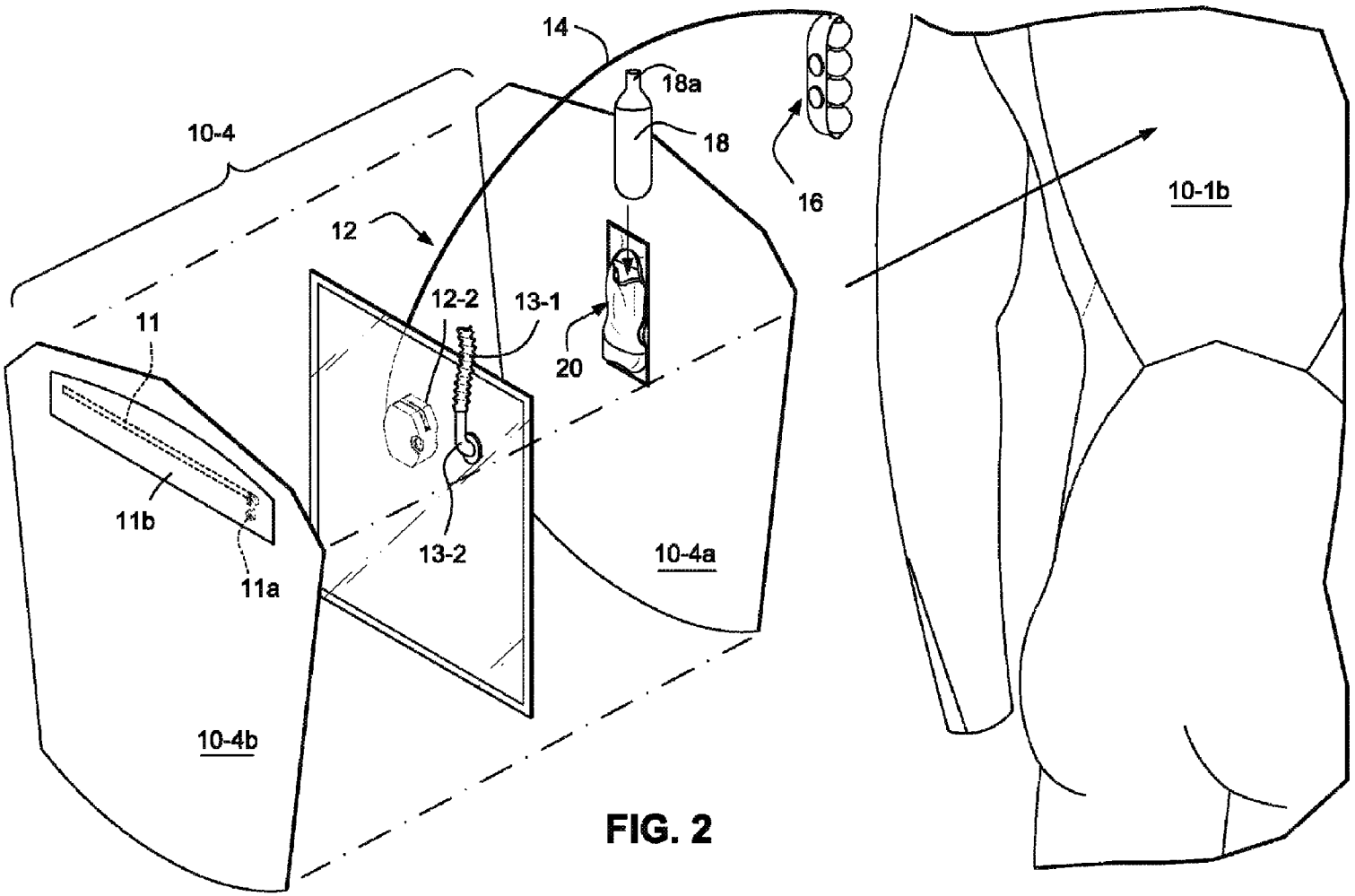
FIG. 2 is an exploded rear perspective view of the wet suit depicted in FIGS. 1A and 1B particularly showing the inflatable region thereof.

The back pocket 10-4 and the components contained therewithin are more visible in the exploded perspective view of FIG. 2. As shown, the back pocket 10-4 is formed by an interior and exterior pair of opposed back panels 10-4*a* and 10-4*b*, respectively, which are overlaid with one another and stitched around their peripheral edges directly into the rubber material forming the back torso section 10-1*b* of the wet suit 10. As noted briefly above, a transverse opening 11 (shown closed by a suitable closure member 11*a*) is provided in the exterior panel 10-4*b* and is covered by a flap 10-4*b*. The opening 11 will thus permit access to the interior space 15 of the back pocket 10-4 when the closure member 11*a* is opened.

Figure 3:
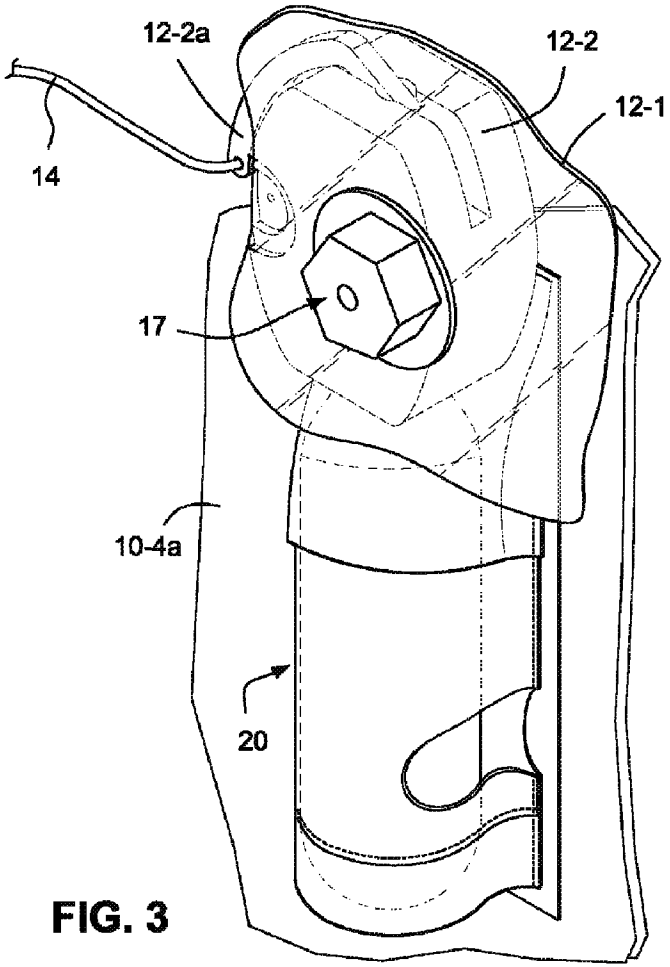
FIG. 3 is an enlarged perspective view of the inflator assembly showing the gas canister positioned in the canister pouch and operatively connected to an actuator valve associated with the inflatable bladder assembly.

The interior space 15 formed between the panels 10-4*a* and 10-4*b* removably receives the bladder assembly 12 (e.g., which may be inserted physically into the space 15 through the opening 11). As shown in FIG. 3, the gas canister 18 is received by and removably retained within the canister pouch 20. The placement of the gas canister 18 within the canister pouch 20 dependently supports the bladder assembly 12 within the back pocket 10-4 by virtue of the mechanical coupling of the canister 18 via its stem 18-1 to the valve 12-2 and the physical attachment of the valve 12-2 to the bladder bag 12-1 (e.g., via the nut and washer assembly 17 associated with the valve 12-2). Thus, the bladder bag 12-1 can be positionally maintained within the interior space 15 of back pocket 10-4 without fear of wrinkling or the like which could impede and/or inhibit its capability for full inflation.

Figure 4:
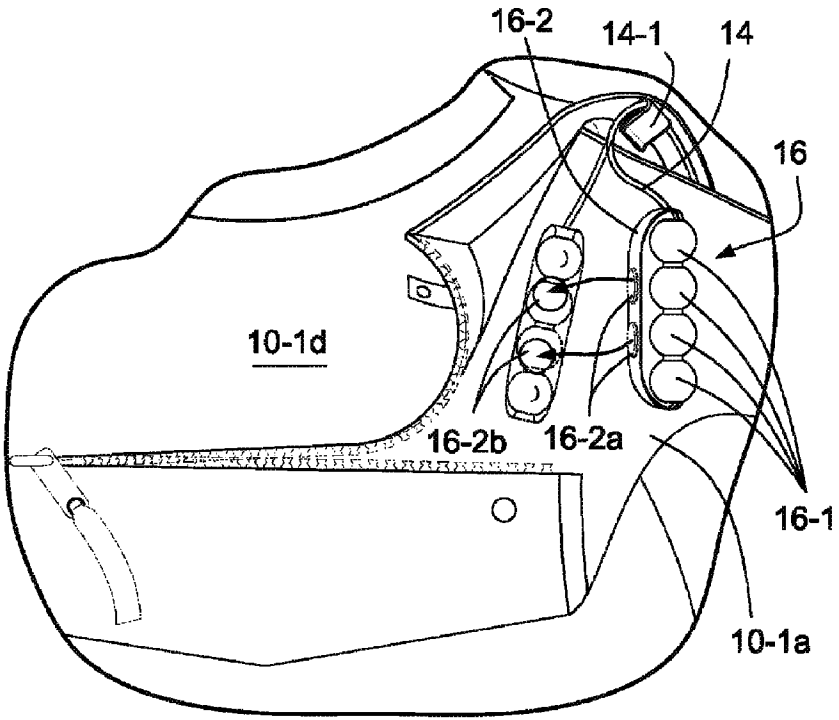
FIG. 4 is an enlarged close-up view of the rip-cord handle used to manually actuate the actuator valve of the inflator assembly.

Accompanying FIG. 4 depicts in greater detail the handle assembly 16 attached to the distal end of the rip cord 14. As shown, the handle assembly 16 is most preferably formed by a series of coaxially aligned beads 16-1 that fixed to and surround a distal end section of the rip cord 14. The coaxially aligned beads 16-1 are thus preferably capable of independent movement relative to one another which allow the handle assembly 16 to flex relative to the axis of the rip cord 14. Such flexion of the beads 16-1 will thus promote comfort during use and also provide for a tactile sensation to aid the user. If desired, a one-piece handle assembly 16 may be provided in which case suitable tactile impressions and/or grip surfaces may be physically molded or formed thereon.

The beads 16-1 are bridged by a retainer strap 16-2 carrying one part 16-2*a* of a two-part fastening system. The other part 16-2*b* of the fastening system is fixed to the shoulder region of the front torso section 10-1*a*. Connection of the fastening parts 16-2*a* and 16-2*b* will thus retain the beads 16-1 of the handle assembly in a ready position against the shoulder region of the upper torso section 10-1*a* (shown by dashed line in FIG. 4). Although a two-part snap system is depicted, various other suitable fasteners may similarly be employed (e.g., a hook and loop (e.g., VELCRO-Brand) fastener). The strap 16-2 also provides a space between the beads 16-1 through which a user's fingers may be inserted. As such, the strap 16-2 will facilitate the user exerting a reliable grip on the beads 16-1 to allow the handle assembly to be reliably pulled in an emergency situation so as to cause inflation of the inflatable bladder 12-1.

As noted previously, during normal use the handle assembly 16 is hidden under the bib flap 10-1*d* to prevent inadvertent actuation of the inflator assembly 12 with the rip cord 14 extending from the handle assembly 16 to the actuation lever 12-2*a* over the shoulder region of the front and back torso sections 10-1*a* and 10-1*b*, respectively. The rip cord 14 is positionally retained within eyelets (one of which is depicted in FIG. 4 by reference numeral 14-1). In preferred embodiments, the eyelets 14-1 have one end fixed to the material of the wet suit 10 and another free end carrying one part of a two part fastener system (e.g., a hook and loop (VELCRO-Brand) fastener) to allow a user to position the rip cord 14 within the channel formed by the eyelet.

Figure 5C:
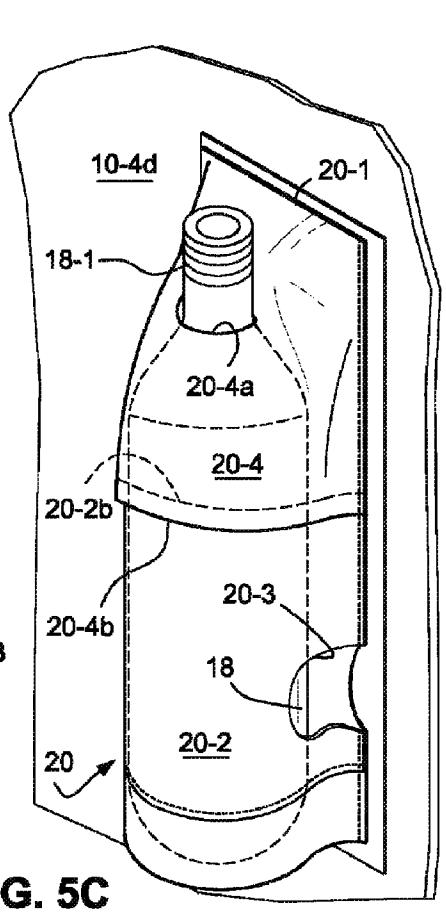
FIGS. 5A-5C depict a sequence for positioning the canister in the canister pouch so as to arm the inflator assembly.
Figure 5B:
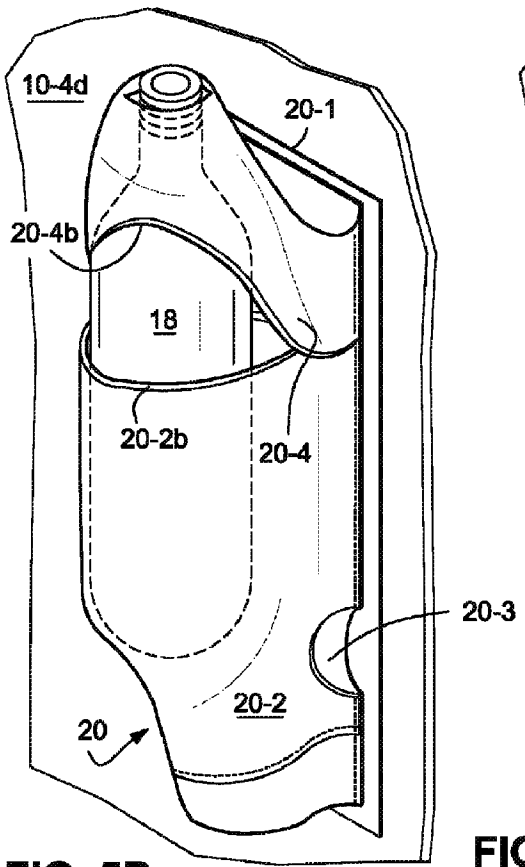
Figure 5A:
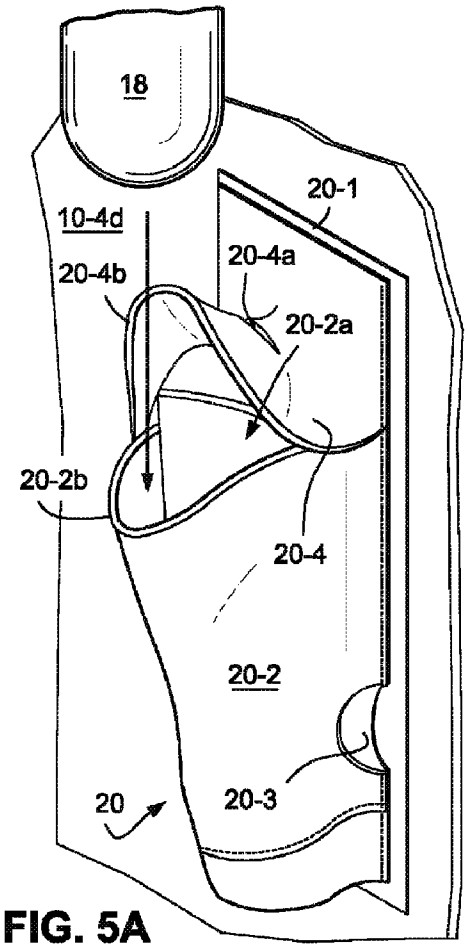

The manner in which the gas canister 18 is assembled within the canister pouch 20 is depicted by accompanying FIGS. 5A-5C. As is shown in FIG. 5A, a back wall 20-1 is preferably stitched to the back panel 10-4*d* around its perimeter edges. The front wall 20-2 is however preferably stitched to the back panel 10-4*d* along its side and bottom edges so that its upper edge remains unattached. As such, the front wall 20-2 will define a pouch space 20-2*a* with an open upper end 20-2*b* of sufficient size to accommodate the gas canister 18 therewithin. The front wall 20-2 includes opposed cut-out portions 20-3*a* to allow side access to the pouch space 20-2*a* to thereby permit gas canister 18 to be manipulated when positioned therein.

A top flap 20-4 is provided and stitched along its top and side edges to the back panel 10-4*d*. The top flap 20-4 is thus unattached to the back panel 10-4*d* along its bottom edge 20-4*b* which is opposed to the unattached upper edge of the front wall 20-2. The top flap 20-4 includes a central opening 20-4*a* to allow the threaded stem 18-1 of the gas canister 18 to protrude therefrom when positioned in the canister pouch 18 (see FIG. 5C). The top flap 20-4 has a sufficient lengthwise dimension so as to provide a skirt that covers an upper region of the front wall 20-2.

It is preferred that each of the back wall, 20-1, front wall 20-2 and top flap 20-3 is formed of a rubber material (e.g., neoprene) comparable to that forming the torso sections 10-1*a* and 10-1*b*. The back wall 20-1, front wall 20-2 and top flap 20-4 are thus sufficiently elastic to allow each to be resiliently stretched during placement of the canister 18 within the pouch 20. As shown in FIG. 5B, therefore, the elastic resiliency of the top flap 20-3 allows it to be stretched to expose the pouch space 20-2*a* defined by the front wall 20-2 to thereby permit the canister 18 to be inserted therein. Once the canister 18 is positioned in the pouch space 20-2*a*, the top flap 20-4 may then be stretched over the stem 18-1 of the canister 18 so the stem 18-1 can be forced to protrude through the opening 20-4*a*. With the top flap 20-4 extended over the canister 18 such that the stem 18-1 extends through the opening 20-4*a*, the canister 18 will be positionally retained within the pouch 20. Moreover, the elastic rubber nature of the walls 20-1, 20-2 and the top flap 20-4 will serve to reliably hold the canister 18 in the pouch 20 during the water sports activities associated with the wet suit.

Once the canister 18 is positioned within the canister pouch 20, it may be threadably coupled to the inflator valve 12-2 of the bladder assembly 12. To accomplish this task, the threaded neck 18-1 of the canister 18 will initially be aligned with a threaded female coupling (not shown) associated with the inflator valve 12-2. Finger contact may be established with the sides of the canister 18 in the pouch 20 by virtue of the cut out portions 20-3 to allow the canister 18 to be rotated within the pouch space 20-2*a* and thereby thread the neck 18-1 thereof into the female coupling of the inflator valve 12-2. After finger tight threaded coupling has been established between the canister 18 and the inflator valve 12-2, the inflator assembly 12, and hence the wet suit 10, will then be "armed" and ready for use as depicted in FIG. 3.

Figure 6A:
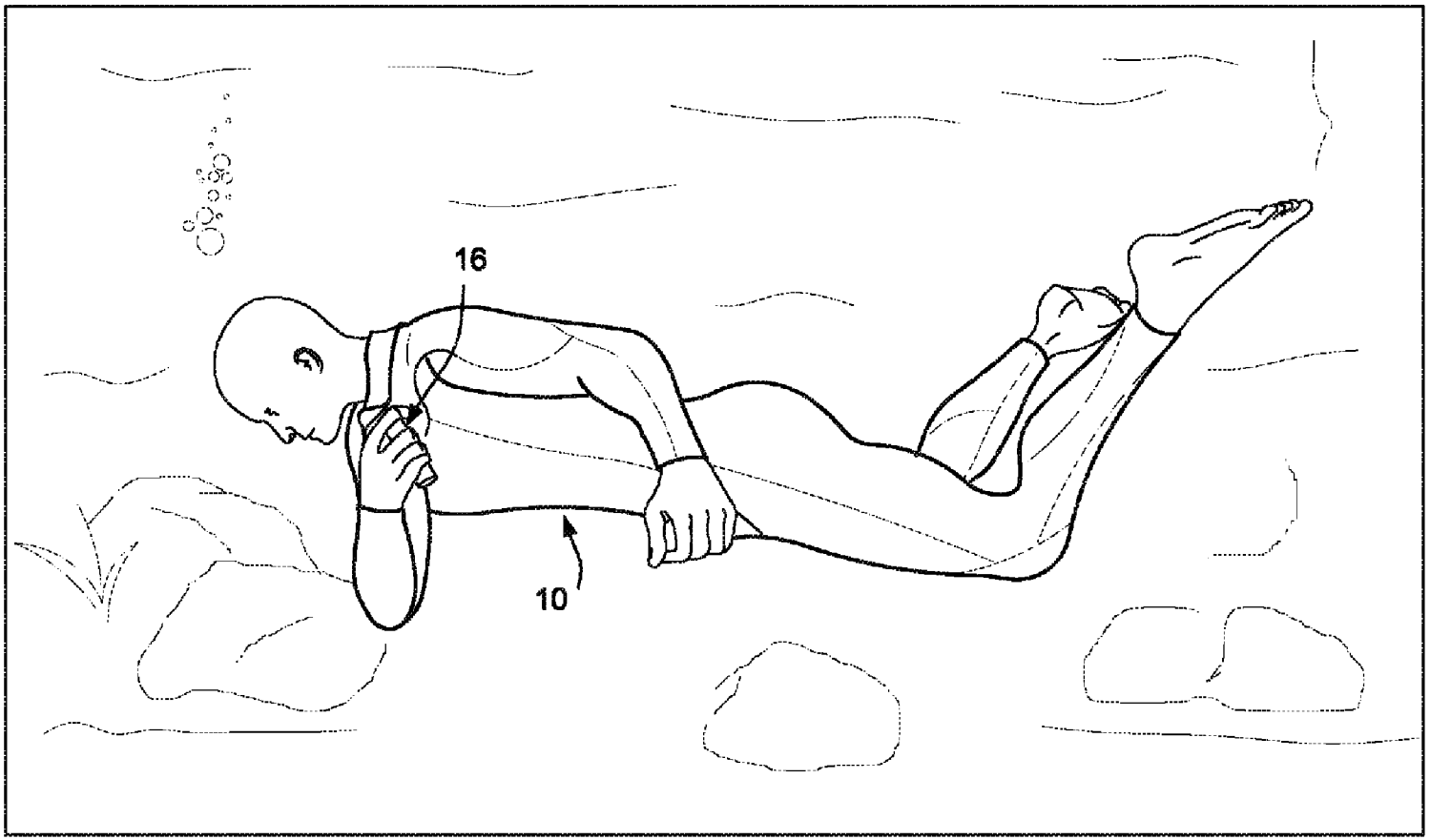
FIGS. 6A and 6B depict a sequence of operation of the inflatable wet suit embodying the present invention.
Figure 6B:
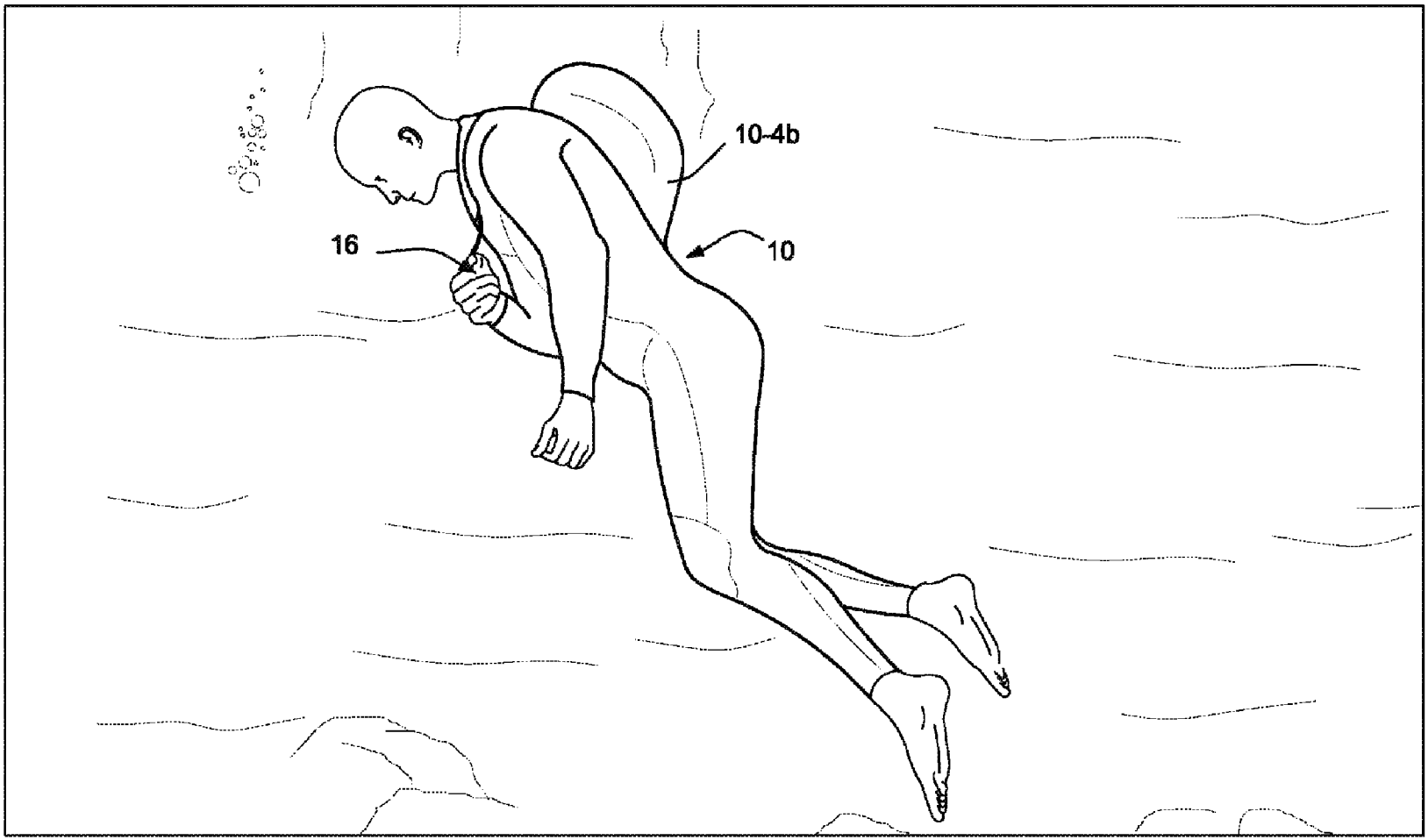

Accompanying FIGS. 6A and 6B schematically show a water sports enthusiast in an underwater emergency situation. In the example depicted, a surfer wearing a wet suit 10 as described above is trapped underwater by hydraulic action of the waves which prevent the surfer from surfacing for air. When the surfer determines that an unsafe situation exists, s/he may access and grasp the handle assembly 16 as is shown in FIG. 6A. A sharp pull on the handle assembly 16 causes the rip cord 14 to move the actuator lever 12-2*a* of the inflator valve 12 which in turn releases the compressed gas within the canister 18 through the valve 12-2 to fill the bladder bag 12-1. The decompressed gas released from the canister 18 will thus inflate the bladder bag 12-1. Since the back panel 10-4*b* is formed of a rubber material (e.g., neoprene), it will resiliently expand with inflation of the bladder bag 12-1. The increased buoyancy provided by the inflated bladder bag 12-1 will thus cause the surfer to ascend rapidly to the water surface as depicted in FIG. 6B. Moreover, depending on the submerged depth of the surfer when the bladder bag 12-1 is inflated, further inflation, and hence buoyancy, will occur due to the decreasing surrounding water pressure during the ascent.

Upon reaching the surface of the water, the enthusiast may manually deflate the bladder bag 12-1 by operating the normally closed deflation valve 13-3 associated with the deflation assembly 13. In this way, the water sports enthusiast can manually decrease buoyancy as needed and/or completely deflate the bladder bag 12-2 so it can be rearmed with a fresh canister 18 to allow for more water sports activities.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope thereof.

What is claimed is:

1. An inflatable wet suit comprising:

a torso section having a back pocket;

a bladder assembly positioned within the back pocket, the bladder assembly comprising an inflatable bladder bag and an inflator valve adapted for operative connection with a compressed gas canister;

a rip cord having one and other ends with the one end being connected to the inflator valve, the rip cord extending over a shoulder region of the torso section so that the other end thereof is graspably positioned adjacent a front portion of the torso section; and a canister pouch within the back pocket of the torso section for receiving the gas canister therein, wherein the canister pouch includes a front wall attached to the torso section along side and bottom edges thereof with a top edge being unattached to the torso section so as to define a pouch space with an open upper end, and wherein the front wall includes at least one cut-out region to allow manual manipulation of the gas canister positioned in the pouch space.

2. The inflatable wet suit as in claim 1, further comprising a deflation assembly connected operatively to the bladder bag to allow for manual deflation of the bladder bag.

3. The inflatable wet suit as in claim 2, wherein the deflation assembly comprises an elongate flexible deflation tube having a proximal end connected operatively to the bladder bag, and a manually operated normally closed deflation valve at a distal end of the deflation tube.

4. The inflatable wet suit as in claim 1, wherein the canister pouch further includes a top flap fixed to the torso section about top and lateral edges thereof and having an unsecured bottom edge to allow the top flap to extend over and thereby close the open upper end of the pouch space.

5. The inflatable wet suit as in claim 4, wherein the top flap includes an opening therein to allow a neck of the gas canister to protrude therethrough and permit operative coupling of the gas canister to the inflator valve.

6. The inflatable wet suit as in claim 1, further comprising a handle assembly connected to the other end of the rip cord.

7. The inflatable wet suit as in claim 6, wherein the handle assembly includes an attachment to removably attach the handle assembly to the front portion of the torso section.

8. The inflatable wet suit as in claim 7, wherein the handle assembly includes a strap member carrying the attachment.

9. The inflatable wet suit as in claim 6, wherein the handle member includes an aligned series of beads.

10. The inflatable wet suit as in claim 9, wherein the handle member includes a strap member carrying the attachment.

11. The inflatable wet suit as in claim 10, wherein the strap member includes proximal and distal ends connected adjacent to proximal and adjacent ones of the beads.

12. An inflatable wet suit comprising:

a torso section having a back pocket;

a bladder assembly positioned within the back pocket, the bladder assembly comprising an inflatable bladder bag and an inflator valve;

a rip cord having one end connected to the inflator valve and extending over a shoulder region of the torso section so that an opposite end thereof is graspably positioned adjacent a front portion of the torso section; and a canister pouch within the back pocket of the torso section for receiving the gas canister therein, wherein the canister pouch includes:

(i) a front wall attached to the torso section along side and bottom edges thereof with a top edge being unattached to the torso section so as to define a pouch space with an open upper end, and (ii) a top flap fixed to the torso section about top and lateral edges thereof and having an unsecured bottom edge to allow the top flap to extend over and thereby close the open upper end of the pouch space, and (iii) a compressed gas canister positioned within the pouch space and operatively coupled to the inflator valve; wherein (iv) the top flap includes an opening therein to allow a neck of the gas canister to protrude therethrough and permit operative coupling of the gas canister to the inflator valve.

13. The inflatable wet suit as in claim 12, further comprising a handle assembly connected to the other end of the rip cord.

14. The inflatable wet suit as in claim 13, wherein the handle assembly includes an attachment to removably attach the hand handle assembly to the front portion of the torso section.

15. The inflatable wet suit as in claim 14, wherein the handle assembly includes a strap member carrying the attachment.

16. The inflatable wet suit as in claim 13, wherein the handle member includes an aligned series of beads.

17. The inflatable wet suit as in claim 16, wherein the handle member includes a strap member carrying the attachment.

18. The inflatable wet suit as in claim 17, wherein the strap member includes proximal and distal ends connected adjacent to proximal and adjacent ones of the beads.

19. The inflatable wet suit as in claim 12, further comprising a deflation assembly connected operatively to the bladder bag to allow for manual deflation of the bladder bag.

20. The inflatable wet suit as in claim 19, wherein the deflation assembly comprises an elongate flexible deflation tube having a proximal end connected operatively to the bladder bag, and a manually operated normally closed deflation valve at a distal end of the deflation tube.

* * * * *